US006790118B2

(12) United States Patent
Ahn

(10) Patent No.: US 6,790,118 B2
(45) Date of Patent: Sep. 14, 2004

(54) BLOCK SET FOR EDUCATIONAL PURPOSES

(75) Inventor: Yung-Wook Ahn, Seoul (KR)

(73) Assignee: Karlwitte Korea Co., Ltd., Seoul (KR)

( * ) Notice: Subject to any disclaimer, the term of this patent is extended or adjusted under 35 U.S.C. 154(b) by 0 days.

(21) Appl. No.: 10/377,429

(22) Filed: Feb. 28, 2003

(65) Prior Publication Data

US 2004/0082256 A1 Apr. 29, 2004

(30) Foreign Application Priority Data

Oct. 24, 2002 (KR) ..... 20-2002-0031743

(51) Int. Cl.[7] ..... A63H 33/08

(52) U.S. Cl. ..... 446/125; 446/117; 446/124; 434/208; 434/211; 434/258; 434/403

(58) Field of Search ..... 446/85, 117, 124, 446/125; 434/207, 208, 211, 258, 403; 273/160, 153 S

(56) References Cited

U.S. PATENT DOCUMENTS

| | | | | | |
|---|---|---|---|---|---|
| 3,546,792 | A | * | 12/1970 | Sherman | 434/96 |
| 3,918,178 | A | | 11/1975 | Riley | |
| 4,011,683 | A | | 3/1977 | De Sousa | |
| 4,189,151 | A | * | 2/1980 | Klopfenstein | 273/156 |
| 4,274,221 | A | | 6/1981 | Boutet | |
| 4,308,016 | A | | 12/1981 | White | |
| 4,334,870 | A | * | 6/1982 | Roane | 434/211 |
| 4,381,619 | A | * | 5/1983 | Griffin | 446/125 |
| 4,602,908 | A | | 7/1986 | Kroeber | |
| 4,784,392 | A | * | 11/1988 | Johnson et al. | 273/160 |
| 4,808,140 | A | | 2/1989 | Clavet | |
| 5,163,862 | A | | 11/1992 | Philips et al. | |
| 5,653,621 | A | | 8/1997 | Yao | |
| 5,712,979 | A | | 1/1998 | Graber et al. | |
| 5,717,860 | A | | 2/1998 | Graber et al. | |
| 5,721,832 | A | | 2/1998 | Westrope et al. | |
| 5,812,769 | A | | 9/1998 | Graber et al. | |
| 5,819,285 | A | | 10/1998 | Damico et al. | |
| 5,918,213 | A | | 6/1999 | Bernard et al. | |
| 5,960,409 | A | | 9/1999 | Wexler | |
| 5,991,740 | A | | 11/1999 | Messer | |
| 5,993,740 | A | | 11/1999 | Messer | |
| 6,434,536 | B1 | | 8/2002 | Geiger | |
| 6,450,853 | B1 | | 9/2002 | Larws | |
| 6,487,538 | B1 | | 11/2002 | Gupta et al. | |

* cited by examiner

*Primary Examiner*—Derris H. Banks
*Assistant Examiner*—Bena B. Miller
(74) *Attorney, Agent, or Firm*—McCarter & English, LLP

(57) ABSTRACT

The object of this invention is to provide a block set for educational purposes. The block set features that a plurality of block units of the same color are integrated so as to build a block bar, and two or more block bars respectively of different colors are crosswisely combined to build a block bar combination, and two or more block bar combinations interconnect one another to thereby build a variety of structures having two or more colors, wherein the block bars of the same color are symmetrically disposed. The block set thus allows a user to learn a structural stability of the structures, a sense of balance, symmetry, a sense of harmony, etc. in a natural manner, through processes of building the variety of structures and repetition of those processes.

11 Claims, 13 Drawing Sheets

BLOCK SET FOR EDUCATIONAL PURPOSES

TECHNICAL FIELD

The present invention relates, in general, to building block sets for educational purposes and, more particularly, to a block set for allowing a user to learn a structural stability between completed block structures, a sense of balance, symmetry, a sense of harmony, etc. in a natural manner, through processes of constructing a variety of structures and repetition of those processes.

BACKGROUND OF THE INVENTION

As well known to those skilled in the art, educational block sets have been developed so as to allow users to build a variety of structures such as buildings, robots, automobiles, etc. by interlocking a plurality of small block units vertically and/or horizontally. These educational block sets are useful toys in developing children's intelligence.

The educational block sets have been designed for a variety of users; that is, toy blocks in simple shapes such as squares, triangles, circles, etc, are designed for babies and young children, and block combinations in various shapes, interlocking so as to complete a structure through comparatively complex interlocking processes, are designed for high-class students and adults, etc.

In the case of toy blocks for babies and young children, most of block units are shaped as a cube, a ring or a bar, etc., each of which has recesses and protrusions on both opposite sides. In addition, block units with a sunflower shape having a middle-hollow portion, a rectangular pyramid having a recess on the bottom thereof, etc. have been further developed. Babies and young children, etc. are able to learn concepts relevant to figures through those block units taking fundamental shapes, to acquire an ability to solve problems in building structures, and to understand special relations through games of interlocking block units and knocking down them, etc.

However, with the use of the conventional educational block sets, structures have been built by allowing the users to interlock or assemble block combinations at random without following any rule and/or pattern in building the structures. In this regard, the conventional educational block sets have been effective in that the users can experiment or learn a sense of balance or creativity through processes of interlocking, in an irregular manner, the block combinations this way and that. However, the conventional block sets are not so appropriate for the users to learn rules and/or patterns, involved in building structures with interlocking the block combinations, or a sense of harmony in the course of completing structures by interlocking the block combinations.

In infancy when the brain and the body rapidly develop, it is very important in terms of education for a baby to develop creativity, and it is also very important to understand the rules and/or patterns involved in building structures by observing them and to enhance an ability to utilize those rules and/or patterns in daily life.

For this reason, there is a need for an educational block set capable of allowing a user to learn rules and patterns of structures or a sense of harmony as well as creativity through the processes of interlocking the plurality of block combinations to thereby complete a variety of structures.

SUMMARY OF THE INVENTION

The invention provides a block set for educational purposes comprising two or more block bar combinations. Each block bar combination comprises two or more block bars, each block bar having a different color. At least one of the block bars of a block bar combination is arranged crosswise with respect to at least one other block bar of the same block bar combination such that block bars of the same color are capable of being symmetrically disposed with respect to one another when the block bar combinations are interconnected.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
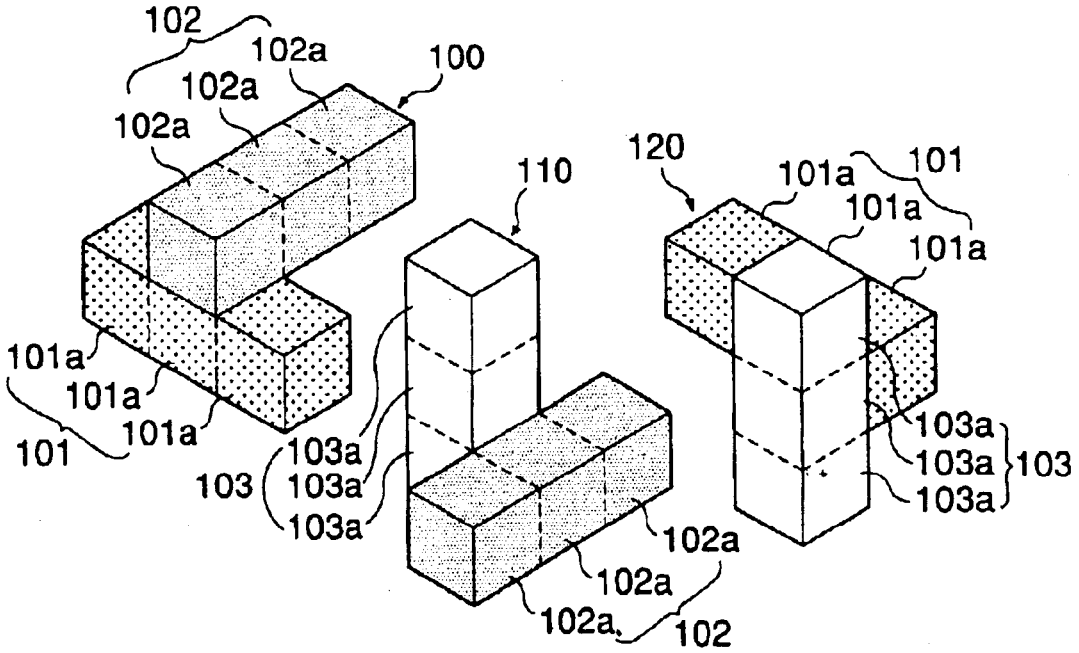
FIG. 1 is a perspective view of an educational block set according to a first embodiment of the present invention.

The present invention has been made keeping in mind the above problems occurring in the prior art. The present invention provides a block set for educational purposes, wherein two or more block bars having different colors, each block bar being a single body composed of a plurality of block units in the same color, are integrated to thereby build a plurality of block bar combinations, and the block bar combinations interlock so as to complete a variety of structures in which the block bars in the same color are symmetrically disposed, thereby allowing a user to discover rules and/or patterns of the block bars in terms of colors, and further enhance an ability to find rules and patterns between objects and articles in his daily life by repeating those processes.

According to one embodiment, the present invention provides a block set for educational purposes comprising a plurality of block bar combinations, wherein each block bar combination is a single body composed of two or more block bars having different colors, which are integrated in a crosswise manner, and each block bar is a single body composed of three or more hexahedral block units in the same color, which are integrated in a straight line, and each block bar of the block bar combinations has a color so that the block bars of the same color are symmetrically disposed when the plurality of the block bar combinations are assembled.

According to another embodiment of the present invention, each block bar combination is composed of two block bars arranged perpendicularly.

According to another embodiment of the present invention, each block bar combination is composed of three block bars arranged at right angles.

According to another embodiment of the present invention, each block bar combination is composed of two block bars of the same color, arranged in parallel while being spaced apart from each other, and a third block bar perpendicularly connecting respective end block units of the two block bars.

According to another embodiment of the present invention, each block bar combination is composed of two block bars of the same color, arranged in parallel while being spaced apart from each other, and a third block bar crossing the central block units of the two block bars.

According to another embodiment of the present invention, each block bar combination is composed of two pairs of block bars, one pair of block bars crossing the other pair of block bars at right angles.

Reference should now be made to the drawings, in which the same reference numerals are used throughout the different drawings to designate the same or similar components. A better understanding of the present invention may be obtained through the following example which is set forth to illustrate, but is not to be construed as the limit of the present invention.

Figure 2A:
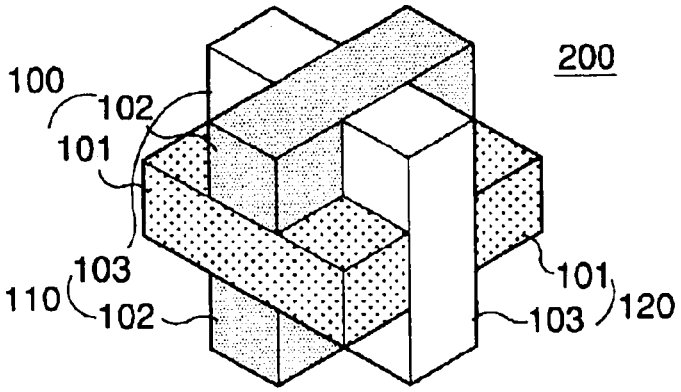
FIGS. 2*a* and 2*b* are perspective views illustrating structures built by the educational block set shown in FIG. 1.
Figure 2B:
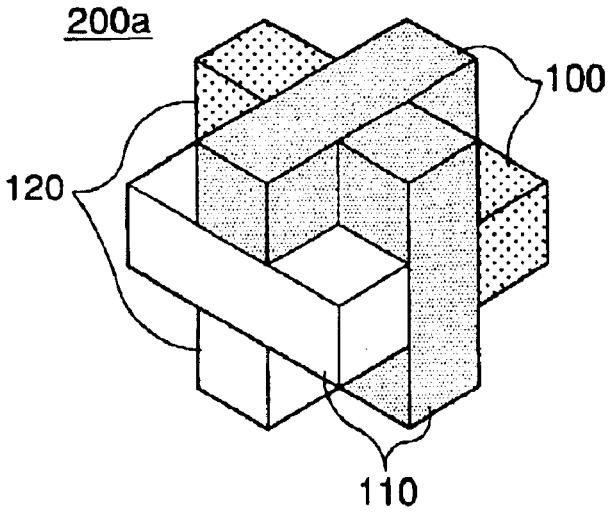

FIG. 1 is a perspective view of an educational block set according to a first embodiment of the present invention, and FIGS. 2*a* and 2*b* are perspective views illustrating structures built by the educational block set shown in FIG. 1.

The educational block set according to the present invention comprises a plurality of block bar combinations, each of which is a single body composed of a plurality of block bars. Each of the block bars is a single body composed of a plurality of block units. FIG. 1 illustrates a block set including a plurality of block bar combinations, each of which is a single body composed of two block bars.

In the block bar combination 100 on the left in FIG. 1, three block units 101*a* of the same color, each having six sides (hexahedron), are integrated to thereby build a block bar 101, and three block units 102*a* of the same color, each having six sides, but different in color from the block bar 101, are integrated to thereby build a block bar 102. The two block bars 101 and 102 are integrated with each other to thereby build a block bar combination 100. At this time, a side of an end block unit 102*a* of the block bar 102 is perpendicularly disposed on a side of the central block unit 101*a* of the block bar 101 and are then fixed so as to allow the block bar combination 100 to take a shape of a T.

The block bar combination 110 at the center in FIG. 1 comprises a block bar 102 the same as the block bar 102 positioned on the top of the block bar combination 100, and a block bar 103 formed with three block units 103*a*, each taking the shape of a hexahedron, being different in color from the block bar 102. A side of an end block unit 103*a* of the block bar 103 and a side of the central block unit of the block bar 102 cross each other and are then fixed.

The block bar combination 120 on the right in FIG. 1 includes a block bar 103 the same as the block bar 103 perpendicularly positioned in the block bar combination 110 and a block bar 101 the same as the block bar 101 positioned on the top of the block bar combination 100. A side of the central block unit 103*a* of the block bar 103 and a side of the end block unit 101*a* of the block bar 101 cross each other and are then fixed.

The three block bar combinations 100, 110 and 120 with the above-described configurations interconnect one another so as to build structures as illustrated in FIGS. 2*a* and 2*b*. In order that the structure 200 has a pleasing appearance, it is desirable that the block bars of the same color are symmetrically disposed.

FIG. 2*a* illustrates a structure 200 completed by regular interconnections of block bars of the same colors (that is, the block bars 101 and 101, 102 and 102, and 103 and 103 interconnect each other), which are symmetrically disposed. The structure 200 interconnected in this way carries a visual effect as if three block walls having different colors cross one another, thereby providing a structural stability. FIG. 2*b* illustrates a structure 200*a* formed by interconnections of block bars, which are irregularly disposed without consideration of any association between colors. The structure 200*a* appears to lack a sense of harmony, thereby carrying no structural stability.

The block bar combinations 100, 110 and 120 interconnect so as to build the structure 200 as shown in FIG. 2*a*, carrying a sense of stability in structure. At this time, the respective block bars 101, 102 and 103 constituting the block bar combinations 100, 110 and 120 are so disposed as to allow the block bars in the same color to be symmetrically disposed, whereby the structure 200 can be more easily built. Through repeating processes of symmetrically disposing the block bars of the same color, the user is able to naturally learn structural symmetry by colors. The user's ability acquired by this learning is likely to further develop so that the user can easily discover any associated rules or patterns relative to objects and articles, etc. in his daily life by observing them or enhance his ability of disposing the objects and the like harmoniously.

FIGS. 3, 5, 7, 9, 11, 13, 15 and 17 illustrates block sets according to different embodiments of the present invention, and FIGS. 4, 6, 8, 10, 12, 14, 16 and 18 demonstrates examples of the structures built by the block sets by the above-described embodiments.

Each educational block set shown in the above-mentioned figures comprises block bar combinations, each of which is a single body composed of three or more block bars. Each block bar is, as described above, built by integrating the three hexahedral block units in an integral manner. Each block bar combination is formed by perpendicular interconnection of the block bars with a variety of arrangements.

Figure 3:
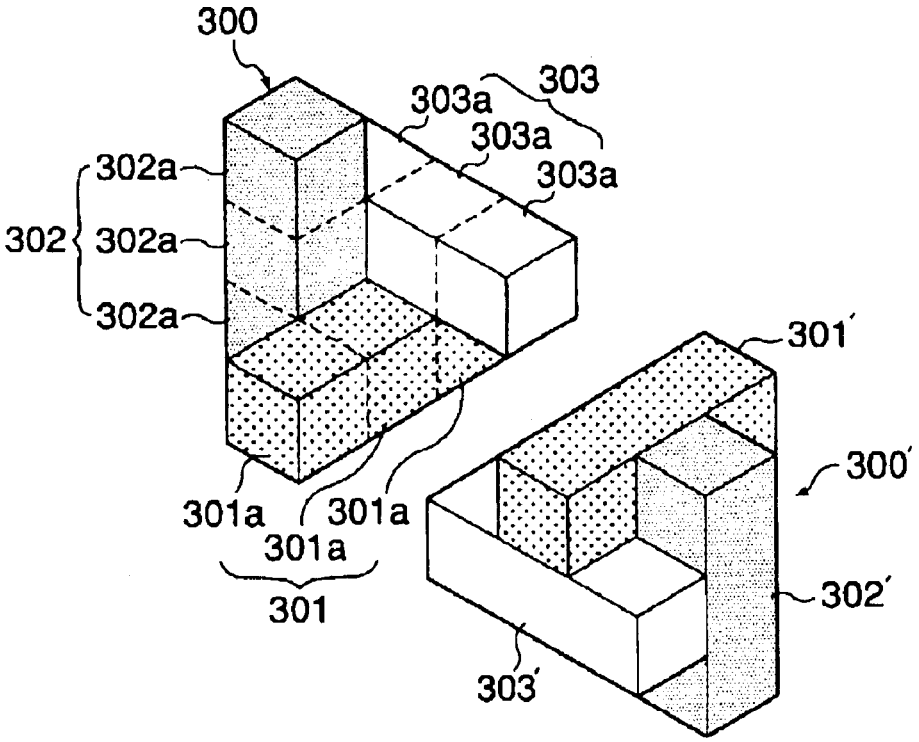
FIG. 3 is a perspective view of the educational block set according to a second embodiment of the present invention.

FIG. 3 shows block bar combinations each comprising three block bars having different colors, wherein a block bar is disposed on a side of the central block unit of another block bar which is disposed on a side of the central block unit of the other block bar. For the sake of convenience in describing this embodiment, three block bars 301, 302 and 303 constituting a block bar combination 300 on the left will be referred to as a first block bar 301, a second block bar 302 and a third block bar 303. The first block bar 301 is a single body composed of three hexahedral block units 301*a* having a first color, the second block bar 302 is a single body composed of three hexahedral block units 302*a* having a second color and the third block bar 303 is a single body composed of three hexahedral block units 303*a* having a third color. A side of the central block unit of the first block bar 301 crosses a side of an end block unit of the second block bar 302, and a side of the central block unit of the second block bar 303 crosses a side of an end block unit of the first block bar 301. The block bar combination 300' in the right is a single body composed of three block bars 301', 302' and 303' identical in shape and color to the three block bars 301, 302 and 303 of the block bar combination 300 in the left, and it is symmetrical to the block bar combination 300 in the left.

Figure 4A:
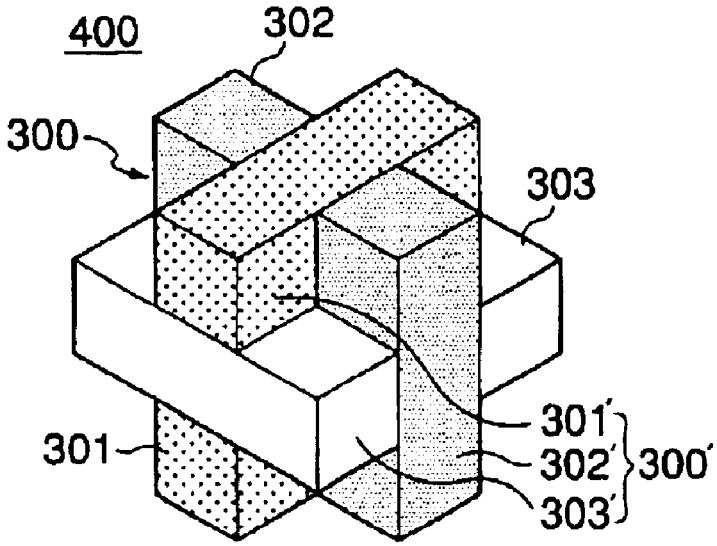
FIGS. 4*a* and 4*b* are perspective views illustrating structures built by the educational block set shown in FIG. 3.
Figure 4B:
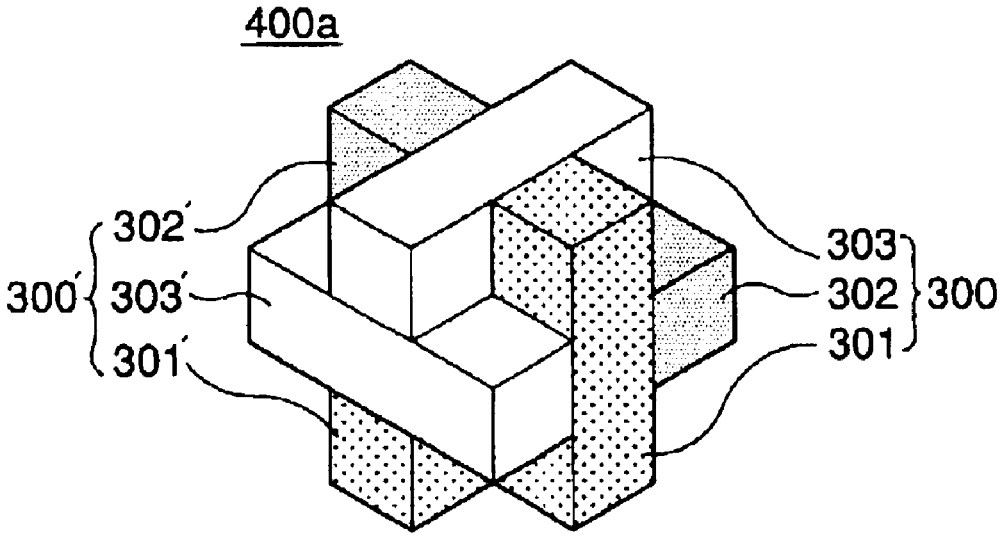

FIG. 4 shows an example of the structures completed by interconnecting the block bar combinations in FIG. 3, wherein the block bar combinations 300 and 300' interconnect each other so as to allow the block bars 301 and 301', 302 and 302' and 303 and 303' respectively having the same colors to be symmetrically disposed. That is, the block bar combinations 300 and 300' interconnect each other so as to build the structure 400 shown in FIG. 4*a*, and the completed structure 400 carries a visual effect that three block walls are crosswisely disposed, thereby providing a sense of stability in structure. FIG. 4*b* shows a structure 400*a* built by interlocking the block bar combinations 300 and 300' wherein the block bars are irregularly disposed, by which the structure 400*a* seems visually unstable since the hexahedral block units 301*a*, 302*a* and 303*a* of different colors are disposed without regularity.

As illustrated in FIGS. 1 and 2 wherein the block bar combinations 100, 110 and 120 interlock, the block combinations 300 and 300' in this embodiment also interlock so as to build the structure 400, by interconnecting the block bars 301 and 301', and 302 and 302', and 303 and 303', both in the same colors, so that they are symmetrically disposed. In the course of building the structure 400, the user can naturally learn an ability of discovering the pattern between objects and articles, etc. and an ability of arranging them harmoniously and regularly.

FIGS. 5 through 18 illustrate structures built by interconnection of the block bar combinations composed of three block bars, wherein the two block bars are symmetrically disposed and arranged in parallel as spaced apart from each other, and the other block bar cross the two block bars in parallel. The two block bars in parallel are of the same color whereas the other block bar is of a different color from the two block bars.

The block bar combinations in FIGS. 5 through 18 refer both to block bar combinations 500, 700, 900, 1100, 1300 and 1700 wherein a side of one block bar is crosswisely disposed on the central block units of the two block bars in parallel, and to block bar combinations 510 and 1500 wherein both sides of the central block unit of one block bar cross the two block bars in parallel.

Hereinbelow, the respective embodiments of the present invention will be described in detail. For the sake of convenience in describing them, the block bars in parallel will be referred to as a first block bar (or a first' block bar) and a second block bar (or a second' block bar), and the other block bar not paralleled will be referred to as a third block bar (or a third' block bar).

Figure 5:
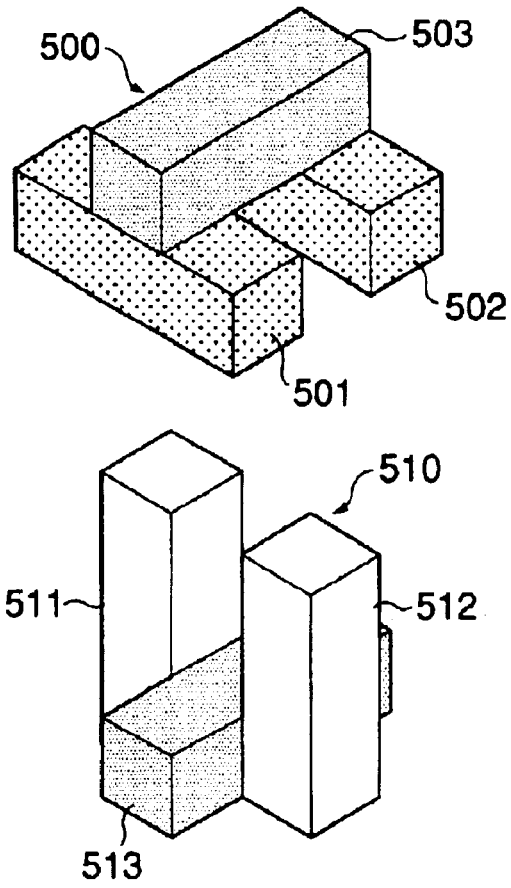
FIG. 5 is a perspective view of an educational block set according to a third embodiment of the present invention.
Figure 6:
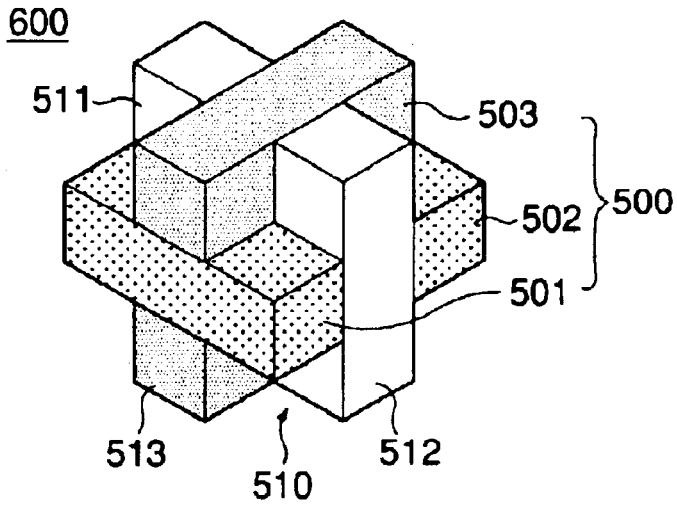
FIG. 6 is a perspective view illustrating a structure built by the educational block set shown in FIG. 5.

In the third embodiment of FIG. 5, a first block bar combination 500 is built by crosswisely disposing both end block units of the third block bar 503 on a side of the central block unit of the first block bar 501 and a side of the central block unit of the second block bar 502, and a second block bar combination 510 is built by crosswisely disposing both opposite sides of the central block unit of the third' block bar 513 between a side of an end block unit of the first' block bar 511 and a side of an end block unit of the second' block bar 512. Desirably, the first block bar and the second block bar have in common the first color, the third and the third' block bars have in common the second color, and the first' block bar and the second' block bar have in common the third color. FIG. 6 shows an example of the structure 600 completed by interconnecting the first block bar combination 500 and the second block bar combination 510.

Figure 7:
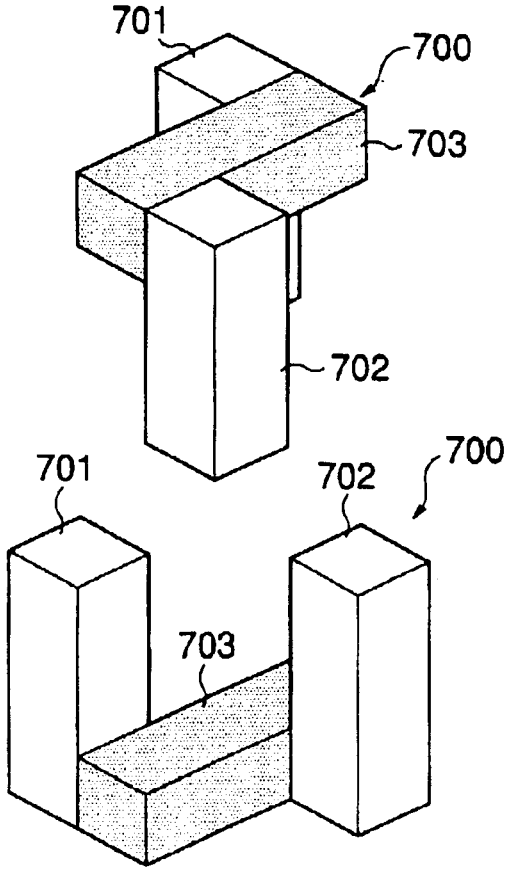
FIG. 7 is a perspective view of an educational block set according to a fourth embodiment of the present invention.
Figure 8:
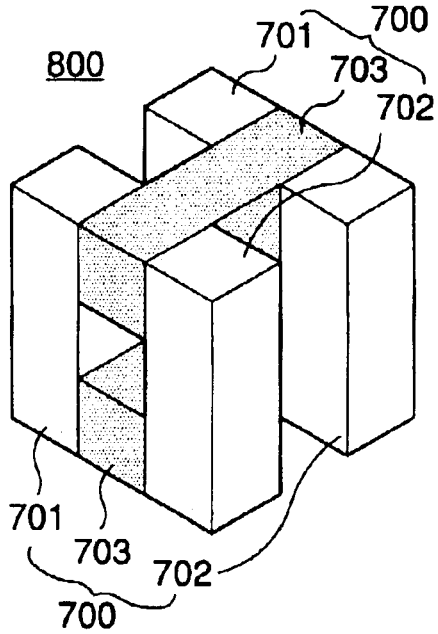
FIG. 8 is a perspective view illustrating a structure built by the educational block set shown in FIG. 7.

In the fourth embodiment of FIG. 7, two block bar combinations 700 having the same configuration are each built by crosswisely disposing an end block unit of the third block bar 703 on an end block unit of the first block bar 701 and crosswisely disposing another end block unit of the third block bar 703 on an end block unit of the second block bar 702. Desirably, the first and the second block bars have in common the first color and the third block bar has the second color. FIG. 8 shows an example of the structure 800 completed by interconnecting the two block bar combinations 700 and 700, which is similar to the structure shown in FIG. 6.

Figure 9:
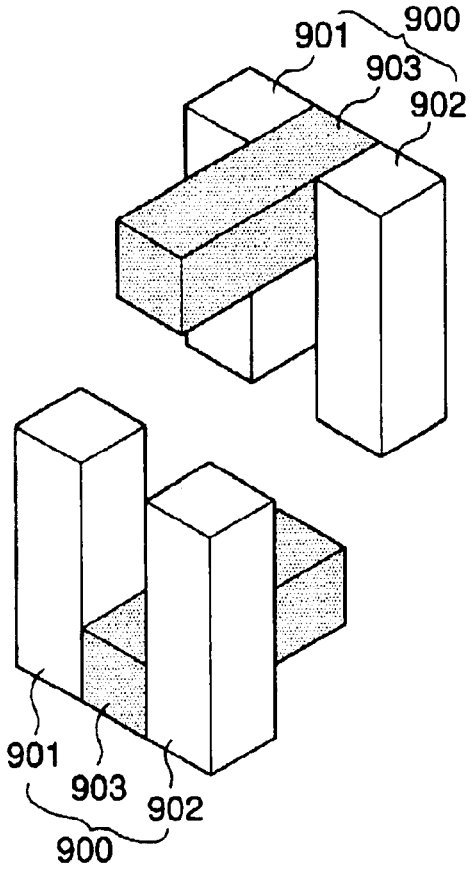
FIG. 9 is a perspective view of an educational block set according to a fifth embodiment of the present invention.
Figure 10:
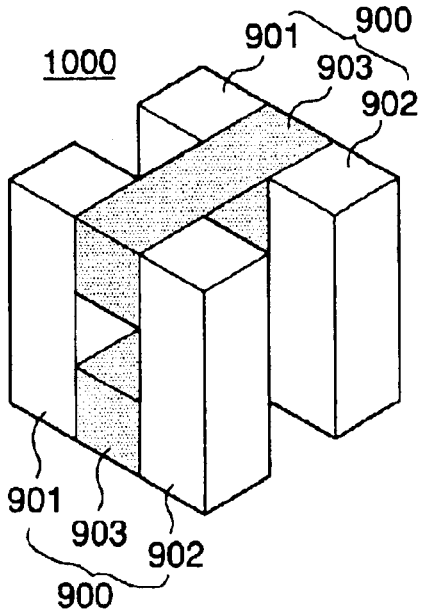
FIG. 10 is a perspective view illustrating a structure built by the educational block set shown in FIG. 9.

In the fifth embodiment of FIG. 9, two identical block bar combinations 900 and 900 are built by crosswisely disposing both end block units of the third block bar 903 between an end block unit of the first block bar 901 and an end block unit of the second block bar 902. Preferably, the first and the second block bars have the first color in common and the third block bar has the second color. FIG. 10 shows an example of the structure 1000 completed by interconnecting the two block bar combinations 900 and 900, which is similar to the structure shown in FIG. 6.

Figure 11:
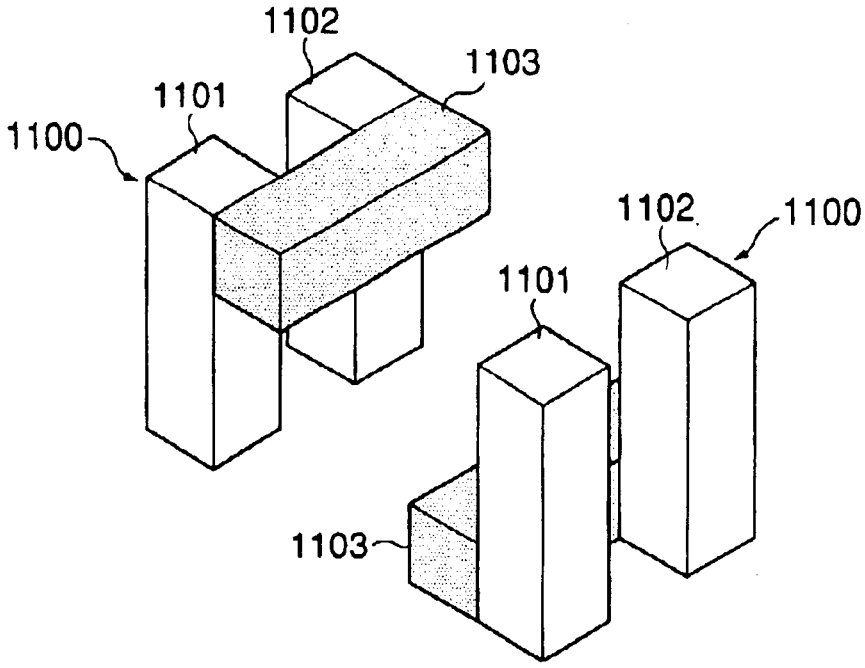
FIG. 11 is a perspective view of an educational block set according to a sixth embodiment of the present invention.
Figure 12:
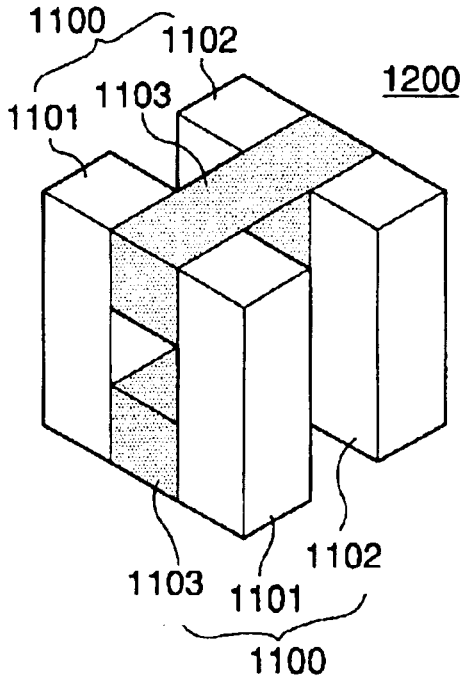
FIG. 12 is a perspective view illustrating a structure built by the educational block set shown in FIG. 11.

In the sixth embodiment of FIG. 11, two identical block bar combinations 1100 and 1100 are built by crosswisely disposing both end block units of the third block bar 1103 on an end block unit of the first block bar 1101 and an end block unit of the second block bar 1102. Desirably, the first and the second block bars have in common the first color and the third block bar has the second color. FIG. 12 shows an example of the structure 1200 completed by interconnecting the two block bar combinations 1100 and 1100, which is similar to the structure shown in FIG. 6.

Figure 13:
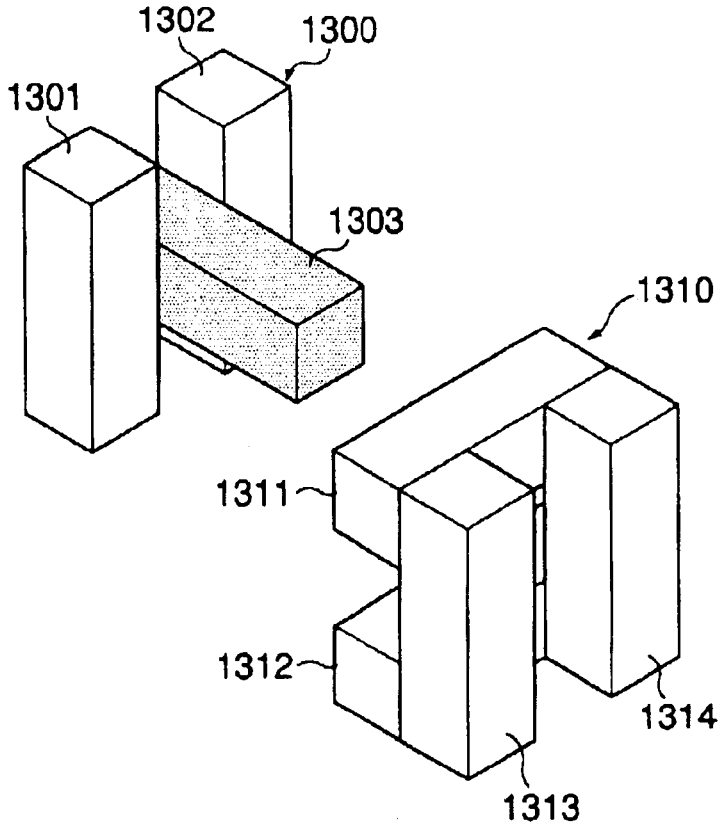
FIG. 13 is a perspective view of an educational block set according to a seventh embodiment of the present invention.
Figure 14:
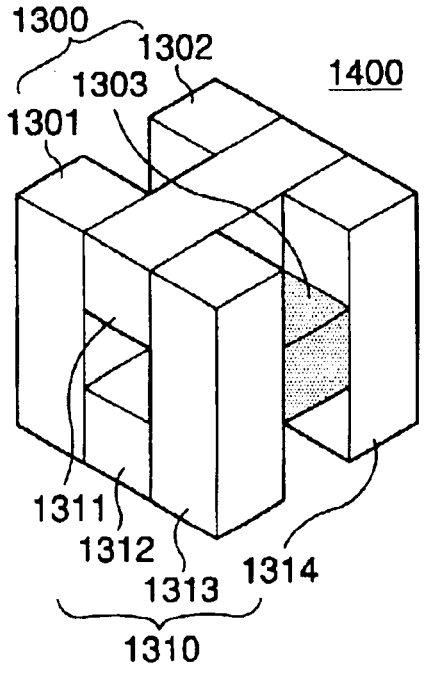
FIG. 14 is a perspective view illustrating a structure built by the educational block set shown in FIG. 13.

In the seventh embodiment of FIG. 13, a first block bar combination 1300 is built by disposing opposite sides of an end block unit of the third block bar 1303 between a side of the central block unit of the first block bar 1301 and a side of the central block unit of the second block bar 1302, and a second block bar combination 1310 is a single body composed of four block bars. The second block bar combination 1310 comprises a pair of block bars 1311 and 1312 horizontally in parallel and a pair of block bars 1313 and 1314 vertically in parallel. In either of the two pairs of block bars, both end block units of the two block bars in a pair are crosswisely disposed on both end block units of the two block bars of the other pair. Preferably, the first and the second block bars have in common the first color and the second block bar combination (block bar?) has the first color. FIG. 14 shows an example of the structure 1400 completed by interconnecting the two block bar combinations 1300 and 1310.

Figure 15:
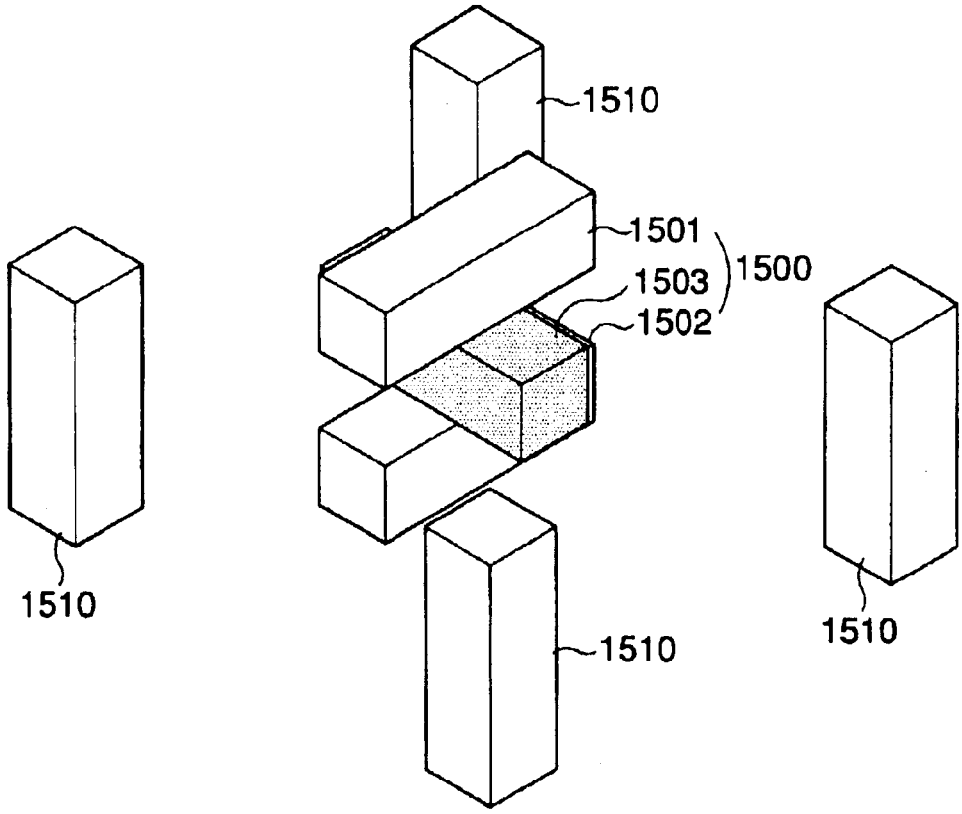
FIG. 15 is a perspective view of an educational block set according to an eighth embodiment of the present invention.
Figure 16:
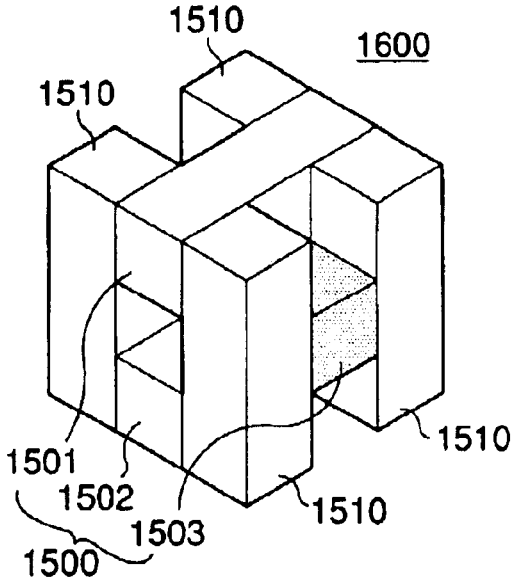
FIG. 16 is a perspective view illustrating a structure built by the educational block set shown in FIG. 15.

In the eighth embodiment of FIG. 15, a block bar combination 1500 is built by disposing the central block unit of the third block bar 1503 between a side of the central block unit of the first block bar 1501 and a side of the central block unit of the second block bar 1502, and there are four extra block bars 1510. Preferably, the first and the second block bars have in common the first color, the third block bar has the second color and the extra block bars have the first color. FIG. 16 shows an example of the structure 1600 completed by interconnecting the block bar combination 1500 and the extra block bars 1510, which is similar to the structure shown in FIG. 14. As described above, by allowing the block bar combination 1500 to interconnect the extra block bars 1510, the structure as completed is vertically symmetrical and it seems more stable visually. Inclusive of the structure shown in FIG. 16, to the completed structure may be added one or more block bars as necessary.

Figure 17:
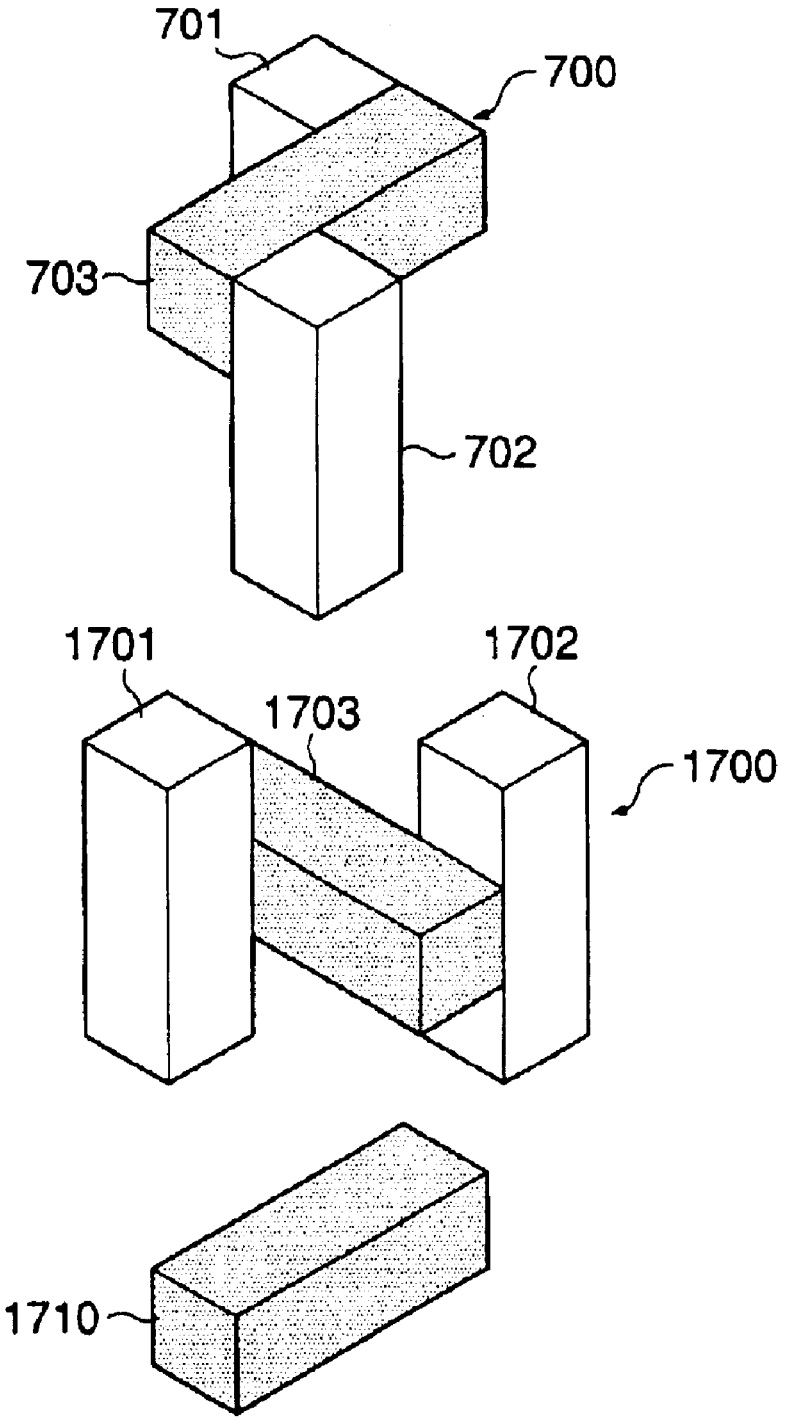
FIG. 17 is a perspective view of an educational block set according to a ninth embodiment of the present invention.
Figure 18:
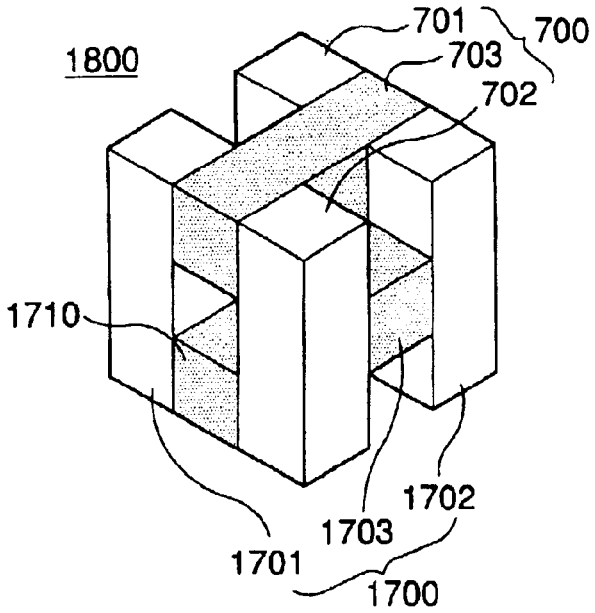
FIG. 18 is a perspective view illustrating a structure built by the educational block set shown in FIG. 17.

In the ninth embodiment of FIG. 17, a first block bar combination 1700 is built by disposing a side of an end block unit of the third block bar 1703 on a side of the central block unit of the first block bar 1701 and a side of another end block unit of the third block bar 1703 on a side of the central block unit of the second block bar 1702, and a second block bar combination 700 is built by disposing a side of an end block unit of the third' block bar 703 on a side of an end block unit of the first' block bar 701 and a side of another end block unit of the second' block bar 703 on a side of an end block unit of the second' block bar 702, and there is a extra block bar 1710. Desirably, the first block bar, the second block bar, the first' block bar and the second' block bar have in common the first color, and the third block bar, the third' block bar and the auxiliary block bar have the second color in common. FIG. 18 shows an example of the structure 1800 completed by interconnecting the two block bar combinations 1700 and 700 and the extra block bar 1710, which is similar to the structure shown in FIG. 14.

As illustrated in the structures 600, 800, 1000, 1200, 1400, 1600 and 1800 of FIGS. 6, 8, 10, 12, 14, 16 and 18, the block bars having the same colors are symmetrically disposed, whereby the completed structures carry a sense of stability in structure. In the course of completing the structures by symmetrically disposing the block bars in the same colors, the user would be able to naturally learn regular disposition of objects and articles, etc. by colors and this ability learned in this way will assist the user to enhance an ability of observing the objects and the like in his daily life and discovering a certain regularity between them and displaying them harmoniously and regularly, the same as in the block sets shown in FIGS. 1 through 4.

Figure 19A:
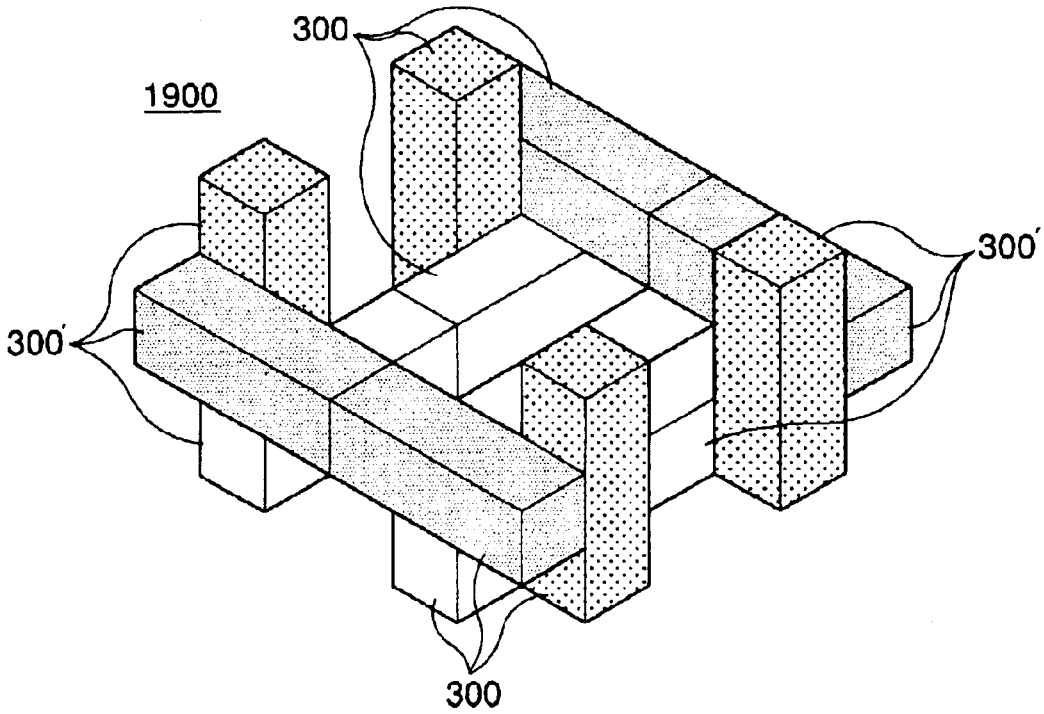
FIGS. 19 and 20 are perspective views illustrating complex structures built by interlocking the block bar combinations shown in FIG. 3.
Figure 19B:
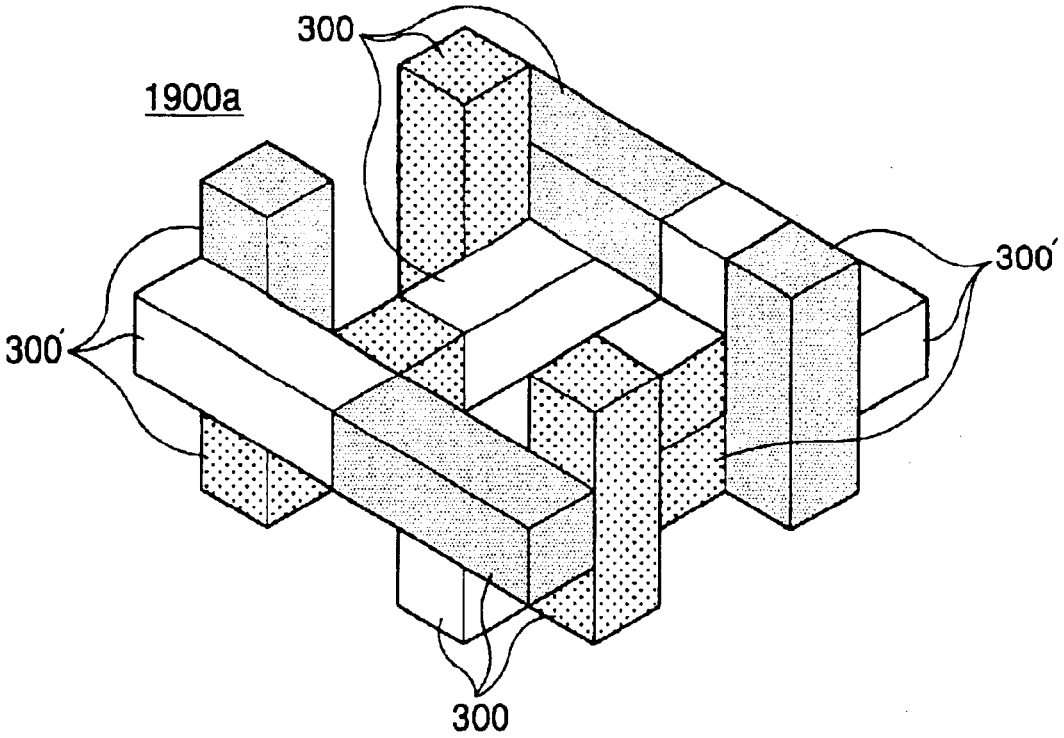
Figure 20:
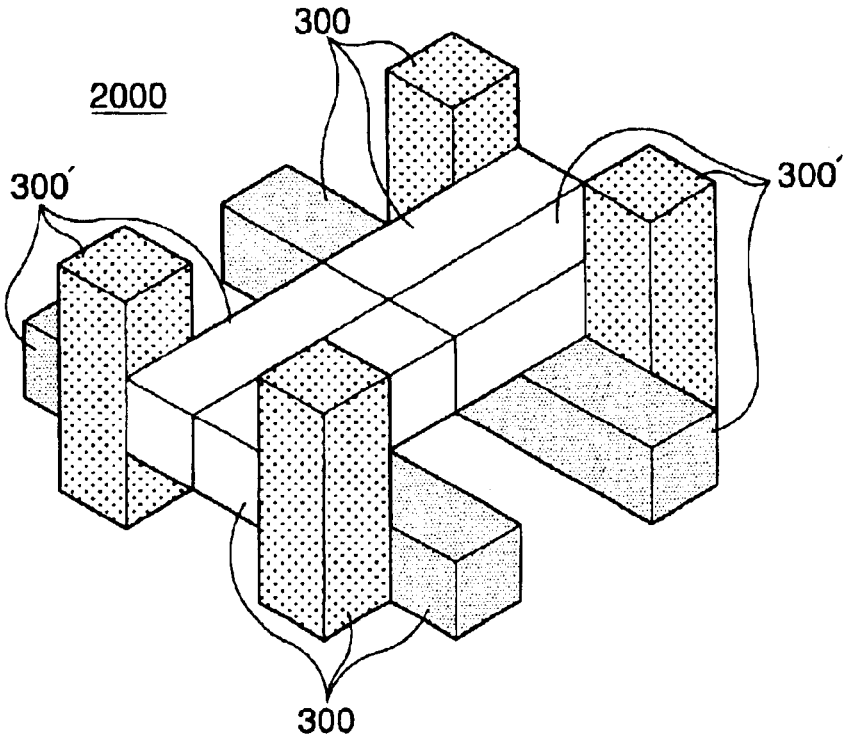

FIGS. 19 and 20 illustrate more complicated structures built by interconnecting the block bar combinations according to the present invention.

To specify, FIG. 19*a* shows a structure 1900 completed by interconnecting the block bar combinations 300 and 300' shown in FIG. 3, wherein the block bar combinations 300 and 300' interconnect each other so as to allow the block bars with the same colors to be disposed in a straight line or to stand opposite to each other, thereby carrying such a visual effect that the structure 1900 has a sufficient inside space like a fence or a rectangular ring.

To the contrary, although the structure in FIG. 19*b* is composed of a block set comprising the block bar combinations 300 and 300' the same as in the structure 1900 of FIG. 19*a*, the completed structure 1900*a* seems unstable in structure and brings about no association with any thing, thereby the user simply recognizing that the block bars are stacked at random, since the block bars are confusingly disposed without regularity in color.

FIG. 20 also shows a structure 2000 completed by interconnecting the block bar combinations 300 and 300' according to the embodiment of FIG. 3. Same as in the embodiment of FIG. 19, the block bar combinations 300 and 300' interconnect each other so as to allow the block bars of the same colors to be symmetrically disposed or stand opposite to each other, thereby allowing an observer to likely associate the completed structure with a bridge or a certain structure.

Figure 21:
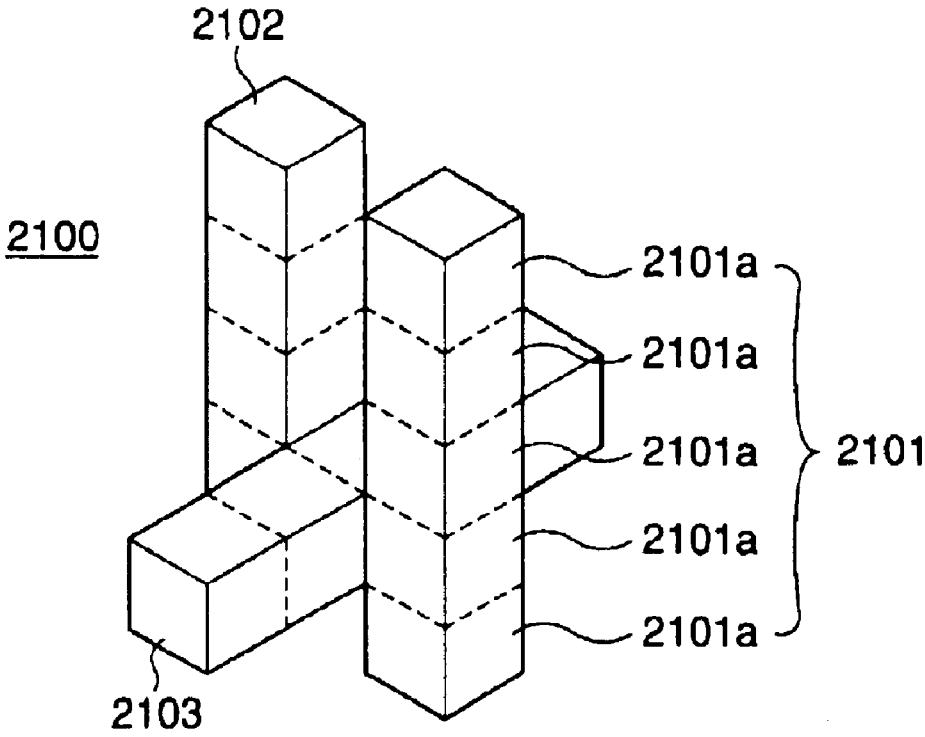
FIG. 21 is a perspective view of an educational block set according to a tenth embodiment of the present invention.

FIG. 21 shows a tenth embodiment of the educational block set according to the present invention. As shown therein, five block units 2101*a* are integrated into a single body. That is, the five block units 2101 form a block bar 2101. Three block bars 2101, 2102 and 2103 formed in this way are interconnected so that two of them cross the other block bar, thereby building a block bar combination 2100. In this figure, the block bar combination 2100 is a single body composed of three block bars, that is, a first block bar 2101, a second bloc bar 2102 and a third block bar 2103, wherein the third block bar 2103 is eccentrically disposed between the first block bar 2101 and the second block bar 2102 in parallel with each other. Desirably, the two block bars 2101 and 2012 in parallel have the same color but the other block bar 2103 has a different color.

According to the present invention, the number of block units constituting the block bars for the block bar combinations constituting the block set according to the present invention and the number of block bars constituting the block bar combinations are not limited and they may also have a variety of modifications. The color of each block bar may vary so as to add any patterns, etc. thereto as long as the block bars can be differentiated.

As described above, the present invention provides an educational block set using interconnected block bar combinations in three colors. With the use of the educational block set according to the present invention, children are able to learn a formative beauty or a sense of balance, etc. from regularities between objects and articles, etc. by understanding visual difference between the structures built by the block bar combinations due to regular arrangement thereof, in the course of building the structures as designated. In addition, the children are able to understand any principle or rule related to objects and articles, etc. by understanding geometrical orders or physical rules from the structures irregularly combined or in disorder. As such, the present invention provides a three dimensional block set useful as an educational instrument in developing an ability to understand and observation skills in children and also in encouraging them to develop creativity during the time when the children's emotional and intelligent brains grow, completely different from conventional block sets focused on repeating simple building of blocks. As a consequence, the block set for educational purposes according to the present invention is very effective in promoting an creative spirit contrary to other previous simple block sets made for children.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A block set for educational purposes, comprising:

two or more block bar combinations, each being built by crosswisely disposing two or more block bars of different colors, respectively, the block bars of the block bar combinations having at least two block bars of the same color, wherein each block bar is built by integrating three or more hexahedral block units of the same color and in a straight line; and the block bars of the same color are symmetrically disposed when the block bar combinations are interconnected.

2. The block set according to claim 1, comprising:

a first block bar combination composed of a first block bar having a first color, including three hexahedral block units, and a second block bar having a second color, including three hexahedral block units, wherein a side of a central one of the block units of the first block bar is crosswisely disposed on a side of an end block unit of the second block bar;

a second block bar combination composed of another second block bar and a third block bar having a third color, including three hexahedral block units, wherein a side of a central one of the block units of the second block bar of the second combination is crosswisely disposed on a side of an end block unit of the third block bar; and a third block bar combination composed of another third block bar and another first block bar, wherein a side of a central one of the block units of the third block bar of the third combination is crosswisely disposed on a side of an end block unit of the first block bar of the third combination.

3. The block set according to claim 1, comprising:

a first block bar combination composed of a first block bar, a second block bar and a third block bar, three of which cross one another, and a second block bar combination symmetrical with the first block bar combination;

wherein the first block bar is composed of three hexahedral block units having a first color, the second block bar is composed of three hexahedral block units having a second color, and the third block bar is composed of three hexahedral block units having a third color, and a side of a central one of the block units of the first block bar is crosswisely disposed on a side of an end block unit of the second block bar, a side of a central one of the block units of the second block bar is crosswisely disposed on a side of an end block unit of the third block bar, and a side of a central one of the block units of the third block bar is crosswisely disposed on a side of an end block unit of the first block bar.

4. The block set according to claim 1, comprising:

a first block bar combination composed of a first block bar having a first color and a second block bar having a first color, arranged in parallel while being spaced apart from each other, and a third block bar having a second color disposed crosswisely with the first and the second block bars; and a second block bar combination composed of a first' block bar having a third color and a second' block bar having the third color, arranged in parallel while being spaced apart from each other, and a third' block bar having the second color disposed crosswisely with the first' and the second' block bars, wherein each block bar is composed of three hexahedral block units;

both end block units of the third block bar are respectively disposed crosswisely on a side of a central one of the block units of the first block bar and a side of a central one of the block units of the second block bar at the same side thereof, and opposite sides of a central one of the block units of the third' block bar are disposed crosswisely on a side of an end block unit of the first' block bar and a side of an end block unit of the second' block bar, respectively.

5. The block set according to claim 1, comprising:

two identical block bar combinations each composed of a first block bar having a first color and a second block bar having the first color, arranged in parallel while being spaced apart from each other, and a third block bar having a second color disposed crosswisely with the first block bar and the second block bar, wherein each block bar is composed of three hexahedral block units; and an end block unit of the third block bar is disposed crosswisely at a first side thereof on an end block unit of the first block bar and another end block unit of the third block bar is disposed crosswisely at a second side thereof opposite to said first side on an end block unit of the second block bar.

6. The block set according to claim 1, comprising:

two identical block bar combinations each composed of a first block bar having a first color and a second block bar having the first color, arranged in parallel while being spaced apart from each other, and a third block bar having a second color disposed crosswisely between the first block bar and the second block bar, wherein each block bar is composed of three hexahedral block units;

opposite sides of an end block unit of the third block bar are disposed crosswisely on a side of an end block unit of the first block bar and a side of an end block unit of the second block bar, respectively.

7. The block set according to claim 1, comprising:

two identical block bar combinations each composed of a first block bar having a first color and a second block bar having the first color, arranged in parallel while being spaced apart from each other, and a third block bar having a second color disposed crosswisely between the first block bar and the second block bar, wherein each block bar is composed of three hexahedral block units;

both end block units of the third block bar are disposed crosswisely at the same side thereof on a side of an end block unit of the first block bar and a side of an end block unit of the second block bar, respectively.

8. The block set according to claim 1, comprising:

a first block bar combination composed of a first block bar having a first color and a second block bar having the first color, arranged in parallel while being spaced apart from each other, and a third block bar having a second color disposed crosswisely between the first and the second block bars; and a second block bar combination composed of four block bars having the first color, wherein each block bar is composed of three hexahedral block units;

opposite sides of an end block unit of the third block bar are disposed crosswisely on a side of a central one of the block units of the first block bar and a side of a central one of the block units of the second block bar, respectively, and the four block bars of the second block bar combination are in two pairs; one pair being arranged horizontally in parallel with each other and the other pair being arranged vertically in parallel with each other, and a side of each end block unit of the two block bars constituting either of pairs is disposed crosswisely on a side of each end block unit of the two block bars constituting the other pair.

9. The block set according to claim 1, comprising:

a first block bar combination composed of a first block bar having a first color and a second block bar having the first color, arranged in parallel while being spaced apart from each other, and a third block bar having a second color disposed crosswisely between the first and the second block bars; and four extra block bars having the first color, wherein each block bar is composed of three hexahedral block units, and opposite sides of the central block unit of the third block bar are disposed crosswisely on a side of the central block unit of the first block bar and a side of the central block unit of the second block bar, respectively.

10. The block set according to claim 1, comprising:

a first block bar combination composed of a first block bar and a second block bar, arranged in parallel while being spaced apart from each other, and a third block bar disposed crosswisely between the first and the second block bars;

a second block bar combination composed of a first' block bar and a second' block bar, arranged in parallel while being spaced apart from each other, and a third' block bar disposed crosswisely between the first' and the second' block bars; and an extra block bar, wherein each block bar is composed of three hexahedral block units, a first side of an end block unit of the third block bar is crosswisely disposed on a side of a central one of the block units of the first block bar, and a second side of another end block unit of the third block bar, opposite to said first side, is crosswisely disposed on a side of a central one of the block units of the second block bar, a first side of an end block unit of the third' block bar is crosswisely disposed on a side of an end block unit of the first' block bar, and a second side of another end block unit of the third' block bar, opposite to said first side, is crosswisely disposed on a side of an end block unit of the second' block bar, and the first, the second, the first' and the second' block bars have a first color in common, and the third, the third' and the extra block bars have a second color in common.

11. The block set according to claim 1, comprising:

a first block bar and a second block bar arranged in parallel while being spaced apart from each other, and a third block bar disposed crosswisely between the first and the second block bars, wherein each block bar is composed of five hexahedral block units, and the third block bar is eccentrically disposed from a central one of the block units of the first block bar and from a central one of the block units of the second block bar.

* * * * *